United States Patent [19]

Seshimo et al.

[11] Patent Number: 5,009,263

[45] Date of Patent: Apr. 23, 1991

[54] HEAT-EXCHANGER UTILIZING PRESSURE DIFFERENTIAL

[75] Inventors: Yuu Seshimo; Masao Fujii, both of Hyogo, Japan

[73] Assignee: Mitsubishi Denki K. K., Tokyo, Japan

[21] Appl. No.: 807,911

[22] Filed: Dec. 11, 1985

[30] Foreign Application Priority Data

Dec. 14, 1984 [JP] Japan ..... 59-264087

[51] Int. Cl.[5] ..... F28D 1/04

[52] U.S. Cl. ..... 165/151; 165/181; 165/903; 165/908

[58] Field of Search ..... 165/151, 908, 903, 181, 165/164, 165

[56] References Cited

U.S. PATENT DOCUMENTS

| | | | |
|---|---|---|---|
| 1,920,313 | 8/1933 | Mautsch | 165/151 |
| 2,958,021 | 10/1960 | Cornelison | 357/82 |
| 3,151,675 | 10/1964 | Lysholm | 165/166 |
| 3,796,258 | 3/1974 | Malhotra | 165/151 |
| 4,108,242 | 8/1978 | Searight et al. | 165/908 X |
| 4,201,195 | 5/1980 | Sakhuja | 165/908 X |

FOREIGN PATENT DOCUMENTS

| | | | |
|---|---|---|---|
| 458226 | 3/1945 | Belgium . | |
| 496733 | 4/1930 | Fed. Rep. of Germany . | |
| 2233047 | 2/1973 | Fed. Rep. of Germany . | |
| 2308969 | 9/1974 | Fed. Rep. of Germany . | |
| 726210 | 5/1932 | France . | |
| 1141200 | 8/1957 | France . | |
| 1374649 | 8/1964 | France . | |
| 2045578 | 3/1971 | France . | |
| 2308075 | 11/1976 | France | 165/123 |
| 318798 | 6/1970 | U.S.S.R. | 165/908 |
| 285938 | 1/1971 | U.S.S.R. | 165/903 |
| 709945 | 1/1980 | U.S.S.R. | 165/181 |
| 341198 | 1/1931 | United Kingdom . | |
| 823543 | 11/1959 | United Kingdom . | |
| 1129564 | 10/1969 | United Kingdom . | |

*Primary Examiner*—Ira S. Lazarus
*Assistant Examiner*—Richard R. Cole
*Attorney, Agent, or Firm*—Sughrue, Mion, Zinn, Macpeak & Seas

[57] ABSTRACT

A heat exchanger including a perforated heat transmission element, a heat transmission enhancing device for producing a pressure difference between opposite surfaces of at least a portion of the perforated heat transmission element, and a main fluid flow guiding structure for guiding the fluid along the perforated heat transmission elements without substantial flow of the fluid through the perforations.

28 Claims, 18 Drawing Sheets

HEAT-EXCHANGER UTILIZING PRESSURE DIFFERENTIAL

BACKGROUND OF THE INVENTION

The present invention relates to a heat exchanger, and particularly to a heat exchanger having a heat transmission element, such as fins, with improved heat transmission characteristics.

FIG. 1*a* and 1*b* are a front view and a side view, respectively, of a conventional heat exchanger of the plate fin-tube type, in which reference numeral 1 depicts a plurality of first heat transmission members in the form of parallel fins arranged in a fluid flow direction A, and 2 a plurality of second heat transmission members in the form of parallel pipes whose temperature is different from that of the first heat transmission members 1 and which are thermally connected to the pipes 2 by pressure contact or soldering. A primary fluid flows through the pipes 2 and a secondary fluid flows outside the pipes, i.e., between the fins 1. Heat exchange is performed between the first and second fluids.

FIG. 2*a* and 2*b* are a front view and a side view, respectively, of a conventional heat sink of a semiconductor element, which is a type of heat exchanger. In FIGS. 2*a* and 2*b*, reference numeral 21 depicts a solid rod which acts as the second heat transmission member and is thermally coupled to the fin 1 by pressure contact or soldering. A semiconductor element (not shown) is pressure contacted to an end face 22 of the solid rod 21. Heat generated in the semiconductor element is transmitted through the solid rod 21 to the fin 1, from which heat is dissipated.

A heat pipe may be used instead of the solid rod 21. The use of a heat pipe is particularly useful when used together with a high performance fin because the heat pipe makes the axial temperature distribution uniform.

In the heat exchanger shown in FIGS. 1*a* to 2*b*, the total area of the fins 1 is usually about 20 times the total surface area of the tubes 2 or the solid rod 21, and therefore the heat transmission characteristics of the fins affect the performance of the heat exchanger substantially.

It is assumed for simplicity that the fin 1 is a flat plate having no holes for the pipes 2 or the solid rod 21 since the area to be occupied by these holes is actually very small.

For such a flat fin 1, there have been various methods proposed to improve the heat transmission characteristics, such as making a temperature boundary layer as thin as possible.

Describing the temperature boundary layer, FIG. 3 is a perspective view of a portion of a corrugated fin type heat exchanger, which is widely used in automotive radiators, etc. In FIG. 3, a second heat transmission element, i.e., pipes 2, through which a primary fluid B such as engine coolant flows are thermally connected to a first heat transmission element, i.e., a corrugated fin 1. A second fluid A such as air flows through gaps formed by the corrugations of the fin 1. The corrugated fin 1, which is equivalent to a plurality of parallel flat fins, has a defect which will be described with reference to FIG. 4, which shows an air flow A around a portion of the fin 1 in FIG. 3.

According to the general theory of heat transmission, when coolant air A flows along opposite, surfaces of the fin 1, a temperature boundary layer 3 is produced along air flow A as shown in FIG. 4. The temperature distribution of the air within the boundary layer 3 is shown by a dotted line in FIG. 4, wherein the temperature of the fin wall is indicated by $t_w$, the temperature of the air flow A outside the boundary layer 3 by t, and the distance from the fin wall by x. The heat transfer coefficient $\alpha$ from the fin 1 to the air flow A is defined in this case by:

$$\alpha = \frac{k(dt/dx)w}{t_w - t\infty}.$$

That is, the variation of for a system in which t, $t_w$ and the thermal conductivity k are constants corresponds to (dt/dx)w, i.e., the gradient of the temperature distribution of the air in the vicinity of the surfaces of the fin 1. That is, the heat transfer coefficient is in proportion to the gradient of the temperature distribution of the fluid in contact with the fin surfaces, which in turn is proportional to tan $\theta$.

Further, since $(t_w - t\infty)$ is a constant, the thicker the boundary layer 3, the smaller the angle $\theta$.

Still further, local heat transfer coefficient in the temperature boundary layer 3 produced along the fin 1 are reduced, and thus the average heat transfer coefficient, namely, the average of the local transmittances, is very low.

In order to resolve this problem, various proposals have been made.

An example of one such proposal is shown in FIG. 5, which shows a perspective view of a portion of a heat exchanger of a type widely used in an automotive or aircraft radiator. The heat exchanger shown in FIG. 5 is referred to as being of the "offset fin" type in which the fin 1 is divided into a plurality of fin pieces (referred to as "strips" hereinafter) as shown. With such strips, the temperature boundary layer 3 is also divided as shown in FIG. 6 (corresponding to FIG. 4), and thus the average thickness of the boundary layer is reduced, resulting in a higher average heat transfer coefficient.

This effect, termed a "leading edge" effect, is utilized effectively in various heat exchangers or other heat transmitting equipment. For example, as seen in FIG. 7, the principle is applied to a heat transmission fin of the plate fin-tube type heat exchanger for use in an air-conditioning apparatus. In FIG. 7, a plurality of fins 10 are arranged in parallel and a plurality of heat transmission pipes through which coolant flows are passed through pipe insert holes 12 of the fins 10, extending orthogonally thereto. The fin 10 is partially stepped to form raised strips 11 so that the boundary layer is divided as shown in FIG. 8.

FIG. 9 shows another example of a fin configuration, specifically, of a type disclosed in Japanese Laid-Open Utility Model Application No. 58184/1981, in which strips 11 are formed at an angle to a fin 10 and the secondary fluid A flows along the strips 11. The configuration of the strips provides the leading edge effect.

FIG. 10 shows in plan view another fin configuration, which is disclosed in Sanyo Technical Review, vol. 15, no.1, February 1983, page 76, and FIG. 11 is a cross section taken along a line XXX–XXX in FIG. 10. In these figures, a fin 10 is formed, in an area between adjacent heat transmission pipes 12, with corrugations in each of which pressed-up portions 11 are formed. In this configuration, the fin is divided into a plurality of inverse-V shaped strips so that fluid flow A is deflected thereby.

FIG. 12 shows another example of a conventional fin, specifically, a fin referred to as a louver fin. Coolant A flows between adjacent strips 11 as shown by a dotted line, and thus the leading edge effect is obtained.

FIG. 13 depicts another example, disclosed in Japanese Laid-Open Patent Application No. 105194/1980, in which a main fluid A flows between fins 1*a* and 1*b*, each formed with a plurality of slits 13 orthogonal to the fluid flow, while passing through the slits. The leading edge effect is provided by an area between adjacent slits.

Problems inherent commonly to these conventional fin configurations utilizing the leading edge effect will be described with reference to FIG. 6.

Firstly, the pressure loss is increased considerably. That is, a boundary layer 3 is produced for each strip but is broken at the trailing edge of the strip. Then, another boundary layer is produced again at a leading edge of a succeeding strip. When the secondary fluid is air (whose Prandtl number Pr is nearly equal to 1), a temperature boundary layer is analogous to a velocity boundary layer. That is, if the temperature boundary layer is thin, the velocity boundary layer is also thin, meaning that the velocity gradient on the heat transmission surface is increased relatively, resulting in a considerable increase of friction loss. As another source of pressure loss, there is a resistance due to the leading edge configurations of the strip, which has a non-negligible thickness. In addition, generally either or both edges of the strip have flashes formed during the fabrication thereof. Therefore, the increase of resistance due to the strip configuration is usually considerable.

Secondly, the degree of improvement of heat transmittance attributable to the leading edge effect is not so much as desired. Specifically, because there exists a velocity loss area behind each strip, the subsequent strip is influenced by such field of velocity, resulting in a reduction of heat transmittance. The same applies for temperature considerations.

In view of the leading edge effect, the strip should be as narrow as possible. In fact, the heat transmittance is improved if the width of the strip is reduced to some extent. However, if the width of the strip is reduced beyond a certain value, the heat transmittance cannot be improved and may be reduced in some cases. Since the reduced width of the strip means a reduced interval between adjacent strips in the second fluid flow direction, the improvement of heat transmittance may be restricted thereby. The conventional configurations shown in FIG. 9 and 11 are employed to avoid such undesirable effects.

Further, a relative reduction of fin efficiency due to the employment of the divided fins is another reason for the restricted heat transmittance.

It has been empirically concluded that the heat transfer coefficient of the fin utilizing the leading edge effect is increased up to by 50% of that of the flat fin and the pressure loss is about $t_w$ ice that of the latter.

Another problem is the mechanical strength of the fin, which is reduced by increasing the number of strips. This problem has become more severe due to the recent tendency of reducing the thickness of the fins for economic reasons.

SUMMARY OF THE INVENTION

An object of the present invention is thus to provide a heat exchanger which has heat transmission surfaces exhibiting superior heat transmission characteristics.

A heat exchanger according to the present invention comprises first heat transmission means disposed along a flow direction of a fluid and having a plurality of through-holes, heat transmission enhancing means for producing a pressure difference between opposite surfaces of at least a portion of the first heat transmission means, and main fluid flow guiding means for guiding the main fluid flow along the first heat transmission means while preventing substantial fluid portion from passing through the through-holes.

According to another aspect of the present invention, the heat exchanger further comprises second heat transmission means thermally connected to the first heat transmission means and having a temperature different from that of the first heat transmission means.

In the heat exchanger according to the present invention, suction and blowing of the fluid are realized in each of the side surfaces of the first heat transmission means through the through-holes. Therefore, the temperature boundary layer on the suction portion becomes thinner and the fluid is agitated in the blowing portion, both effects enhancing heat transmission.

BRIEF DESCRIPTION OF THE DRAWINGS

FIG. 22b is a graph showing the wall pressure for the case in FIG. 22a;

DESCRIPTION OF THE PREFERRED EMBODIMENTS

Figure 14:
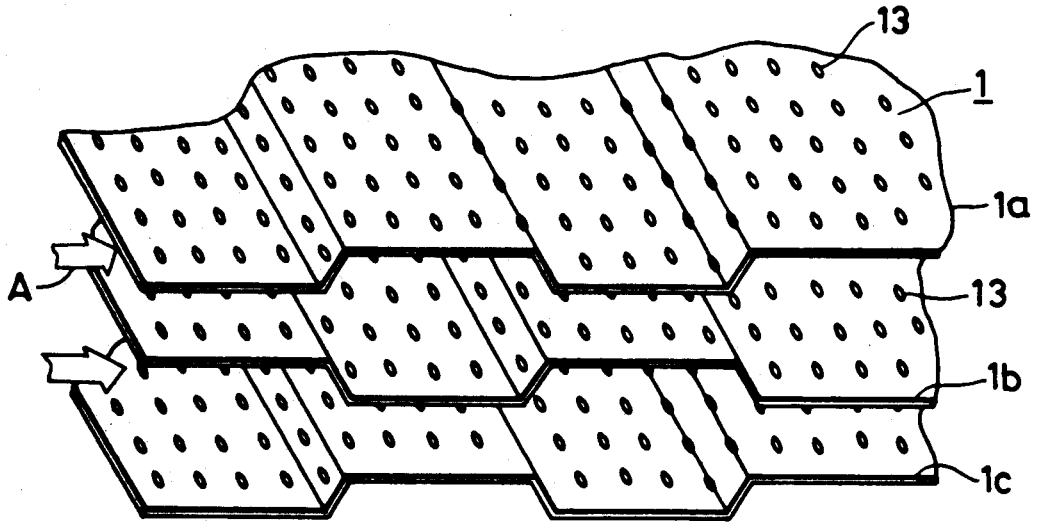
FIG. 14 is a perspective view of a portion of an embodiment of the present invention.

In FIG. 14, which is a perspective view of a portion of an embodiment of the present invention, reference numeral 1 indicates a heat transmission element composed of a stack of heat transmission members 1a, 1b and 1c parallel to fluid flow A, each having a plurality of distributed through-holes 13. The heat transmission element may be a heat transmission portion, a heat generating portion, a heat sink portion, a heat accumulating portion, a heat radiating portions, etc. A fluid passage is formed between adjacent ones of the heat transmission members. Each heat transmission member is bent periodically to form trapezoidal corrugations along the fluid flow direction A. The phase of the corrugations of each heat transmission member differs between adjacent ones of them.

The effects of the embodiment of FIG. 14 will be described with reference to FIG. 15, which shows a cross section of FIG. 14.

Figure 15:
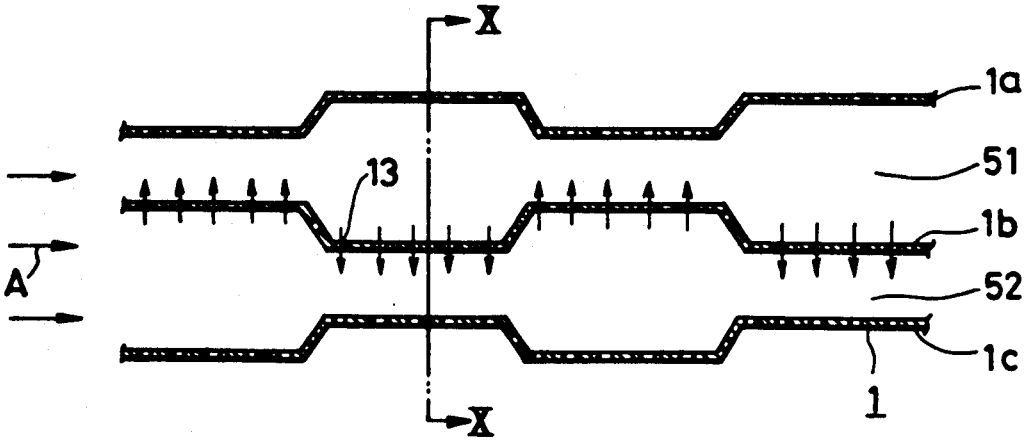
FIG. 15 is a cross section of a portion of another embodiment of the present invention.

In FIG. 15, it is assumed that flow rates and total pressures of fluid portions flowing through a passage 51 formed between the heat transmission members 1a and 1b and a passage 52 formed between the heat transmission members 1b and 1c are the same. Since the cross-sectional areas of the passages 51 and 52 in a plane orthogonal to the fluid flow direction A are different, in a plane taken along a line X—X in FIG. 15, the cross-sectional area of the passage 51 is larger than that of the passage 52, and hence the velocity of the fluid portion flowing through the passage 52 is higher than that flowing through the passage 51, resulting in a static pressure difference therebetween. Therefore, a portion of the fluid may flow from the passage 51 through the through-holes 13 to the passage 52 as shown by small arrows in FIG. 15. The direction of the fluid flow through the through-holes is alternated periodically due to the trapezoidal corrugations of the heat transmission members.

Figure 16:
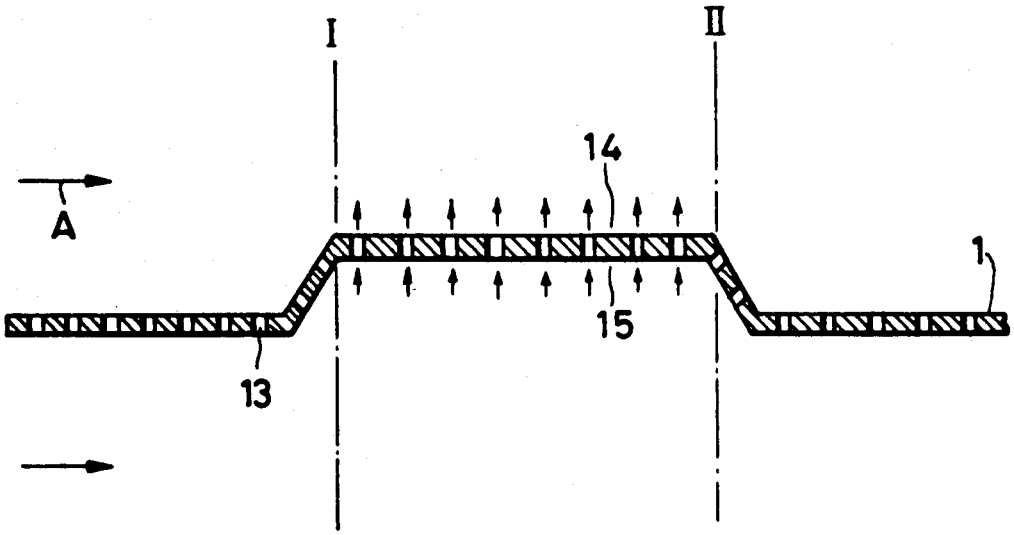
FIG. 16 is a enlarged cross-sectional view of another embodiment of the present invention.

FIG. 16 is an enlarged view of a portion of the heat transmission member 1 shown in FIG. 15. The operation of the present embodiment will be described with reference to a region of the portion defined between lines I and II. As mentioned previously, blowing occurs on one side 14 of the heat transmission member 1 and suction occurs in the other side 15 thereof.

Figure 17:
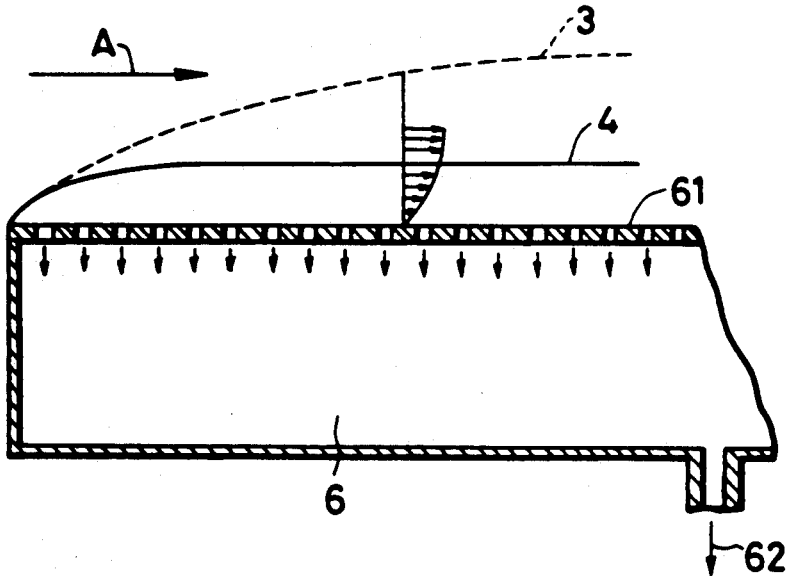
FIG. 17 is an illustration used for an explanation of an operation of another embodiment of the present invention.

First, the suction on the side 15 will be described with reference to FIG. 17 showing a model composed of a negative pressure chamber 6 having one side formed by a porous wall 61 and an opening 62, which is to be connected to a pump (not shown) for maintaining the chamber 6 at a negative pressure. A fluid flows in a direction A along the porous wall 61. In FIG. 17, a velocity boundary layer 4 is produced when the fluid is sucked into the negative pressure chamber 61, which layer 4 is remarkably thinner than a velocity boundary layer 3 produced when there is no suction provided.

This arrangement, widely used in airfoil structures, is effective to stabilize the boundary layer and prevent the transition and peeling of the boundary layer. The boundary layer on the suction side rises to a constant velocity at a leading edge portion, and there is no substantial change of velocity in subsequent portions.

From a knowledge of the relation between the temperature boundary layer and the velocity boundary layer and the relation between these boundary layers and the heat transmittance, the average heat transmittance of the wall 61, the boundary layer of which is kept thin on the average, may be increased with respect to the case of no suction.

On the other hand, on the blowing side 14, the thickness of the boundary layer may have a tendency to increase, contrary to the case on the suction side 15, resulting in a reduction of heat transmittance. According to the present invention, such a defect can be effectively eliminated by establishing the boundary layer at a portion around the point I on the side 14. That is, since the boundary layer in a region immediately preceding the region defined between the points I and II of the side 14 is made very thin due to the suction effect, and since the fluid reaches a leading edge of the region I–II with the cross-sectional area thereof reduced, the boundary layer rises from substantially the point I on the side 14 followed by the region defined between the points I and II. Since the rise of the boundary layer is started at the point I followed by the region I–II in the side 14, there is obtained a high heat transmittance in the same region, which is sufficiently high to overcome the undesired effects of the blowing phenomenon.

According to the embodiment shown in FIGS. 14 to 16, uniform suction regions and uniform blowing regions are arranged alternatively on each side surface of the heat transmission member. In each suction region, the boundary layer is very thin, providing a considerable heat transmission enhancing effect, and, in each blowing region, a high heat transmission performance is achieved by the effects of the rising portion of the boundary layer. Thus, a totally very high heat transmission enhancing effect, which has been otherwise impossible to obtain, is provided according to the present invention.

In the embodiment shown and described above, the amount of fluid passing through the through-holes is made very small so that the main fluid flow A flows substantially along the surfaces of the heat transmission member in each uniform region without being deflected.

This embodiment is featured by the heat transmission member being constituted with a perforated wall, a pressure difference being produced between opposite sides of each portion of the heat transmission member, the higher pressure sides of portions of the heat transmission member being periodically inverted along the fluid flow, the cross-sectional area of the fluid path being periodically changed therealong, and the fluid flow passing along the heat transmission member without substantial flow through the through-holes of the heat transmission member.

Figure 18:
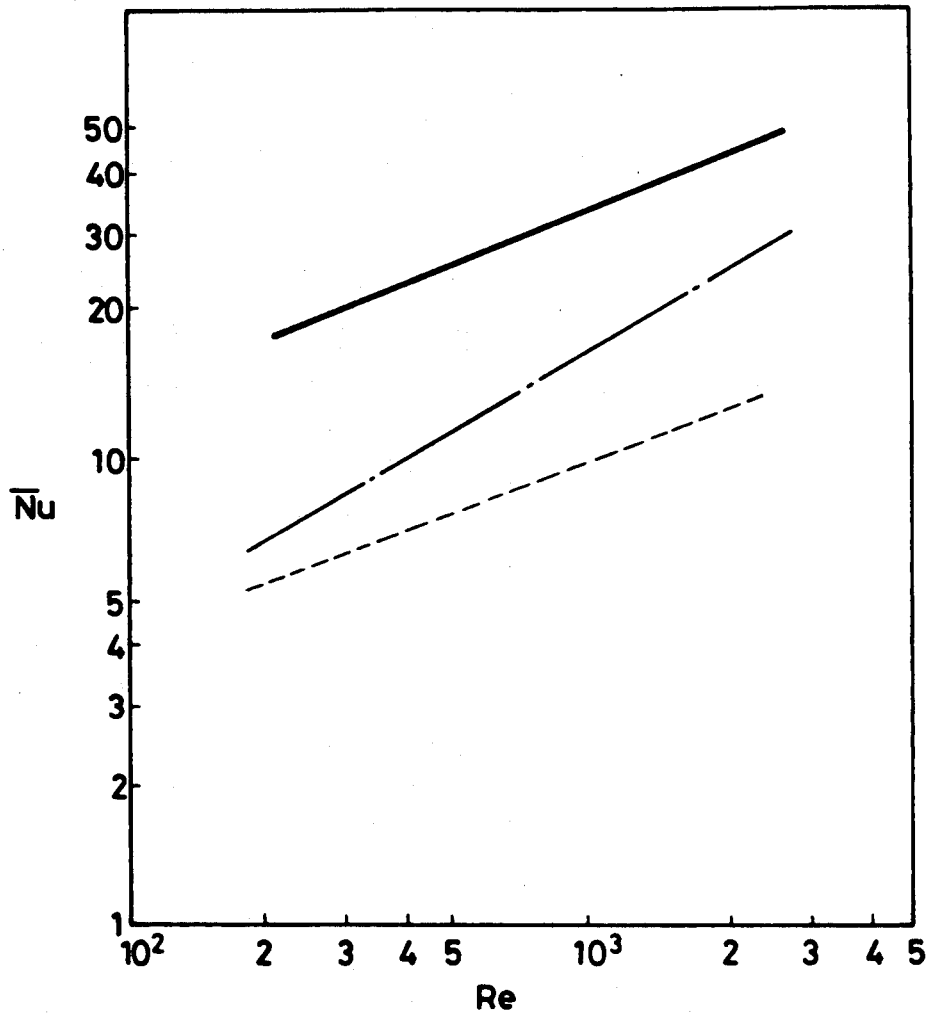
FIG. 18 is a graph showing heat transmission characteristics of another embodiment of the present invention.

FIG. 18 is a graph showing the heat transmission characteristics of the heat transmission member of the present invention with ordinate and abscissa being the Nusselt number $\overline{Nu}$ and Reynolds number Re, which are defined by:

$$Nu = \frac{2 \times \text{(average heat transfer coefficient)} \times \text{(average fin gap)}}{\text{(thermal conductivity of air)}},$$

and $$Re = \frac{2 \times \text{(average fin gap)} \times \text{(velocity defined by average fin gap)}}{\text{(dynamic viscosity coefficient of air)}},$$

respectively. In FIG. 18, a solid-line curve shows the characteristics of the present heat transmission member, a dotted-line curve shows that of a parallel flat heat transmission member, and a chain-line curve shows that of a heat transmission member having the same configuration as that shown in FIG. 14 and having no perforations.

From FIG. 18 it is clear that the present heat transmission member exhibits a heat transfer coefficient about three times that of the conventional parallel flat heat transmission member, which is still considerably lower than that of the non-perforated member. These facts mean that the heat transmission members which define the periodically varying cross-sectional area of the fluid flowing therealong provide an improvement of the heat transmittance, even if they are not perforated. Moreover, this effect increases with an increase of Reynolds number. The effect may be due to turbulence of the fluid flow, repeatedly produced temperature boundary layers, generation of vortices in the fluid, etc.

Figure 19:
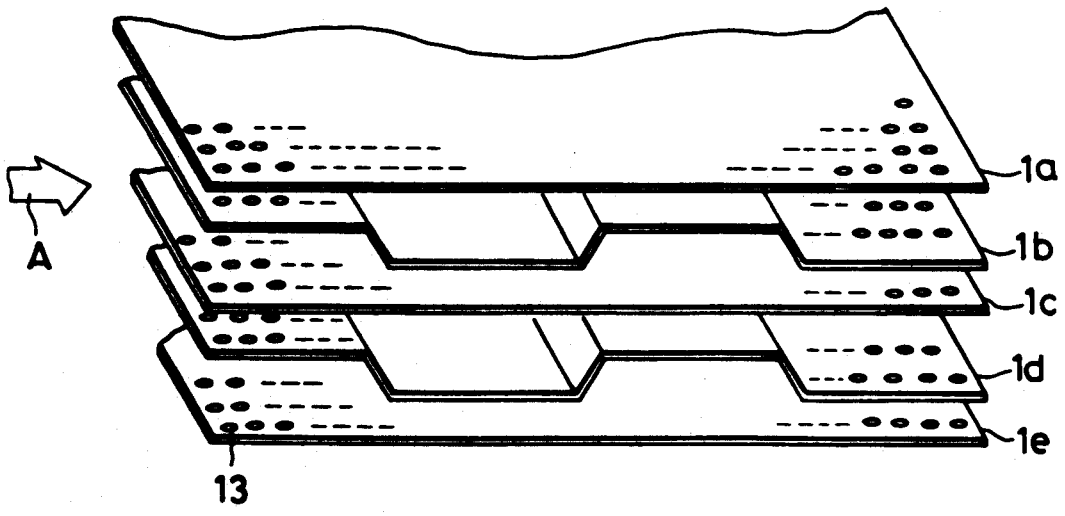
FIGS. 19 and 20 are perspective views of portions of other respective embodiments of the present invention.

FIG. 19 shows in perspective view another embodiment of the present invention. The heat exchange of this embodiment is composed of corrugated and perforated heat transmission members 1*b* and 1*d*, each of which is similar to the heat transmission member 1*a* in FIG. 14, and perforated flat heat transmission members 1*a*, 1*c* and 1*e*, the heat transmission members 1*b* and 1*d* being sandwiched between the flat heat transmission members 1*a* and 1*c* and between the flat members 1*c* and 1*e*, respectively.

The effects of this embodiment are same as those of the preceding embodiment shown in FIG. 14.

Figure 20:
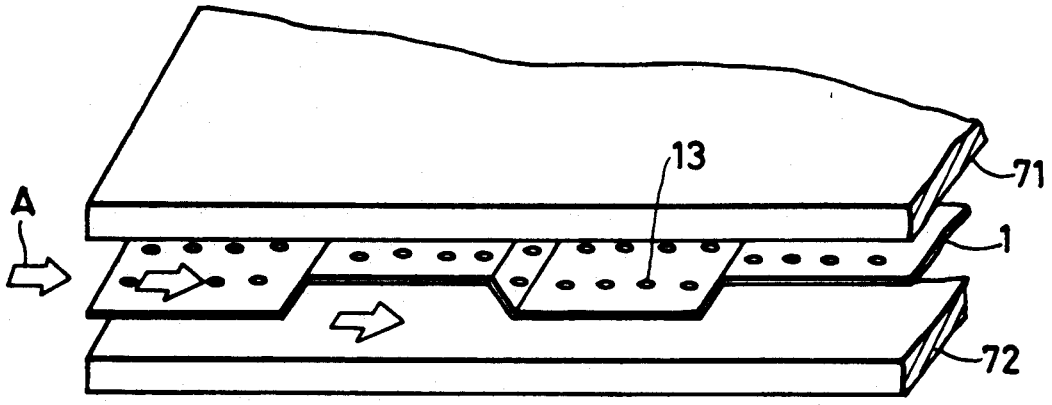

FIG. 20 is a perspective view of another embodiment of the present invention, which is constituted similarly to the embodiment in FIG. 19 except that the flat heat transmission members, here designated by reference numerals 71 and 72, are not perforated. The effects of this embodiment are also substantially the same as those of the embodiments shown in FIG. 14 and 19.

Figure 21A:
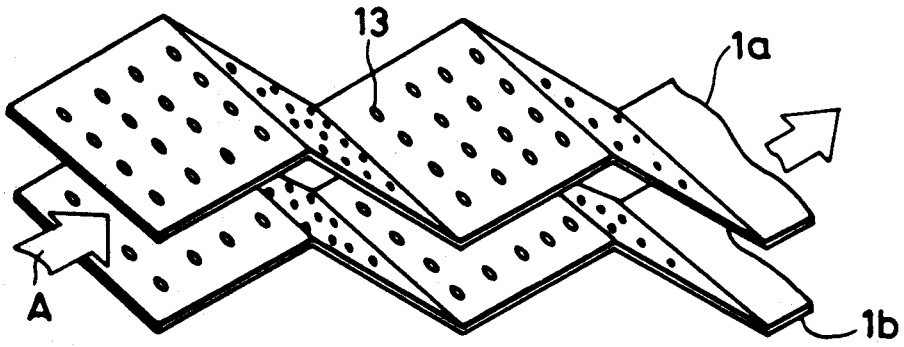
FIG. 21*a* and 21*b* show an embodiment of the present invention in a perspective view and in cross section, respectively.
Figure 21B:
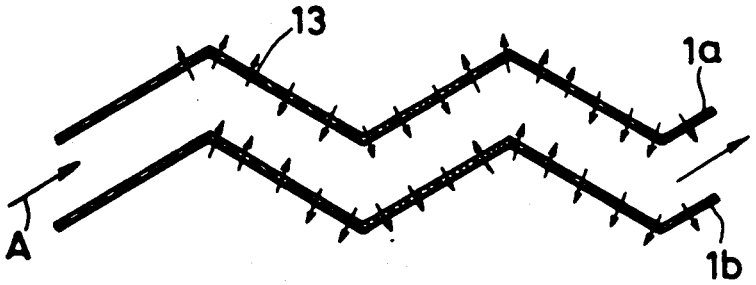

FIGS. 21*a* and 21*b* show a still further embodiment of the present invention in a perspective view and in a cross-sectional view, respectively.

Figure 22A:
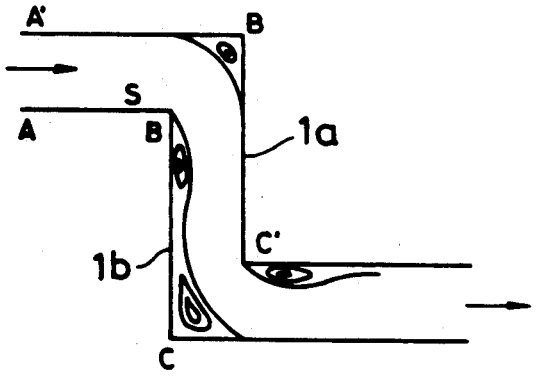
FIG. 22*a* is an explanatory illustration of wall pressure in the embodiment of FIG. 21*a*.
Figure 22B:
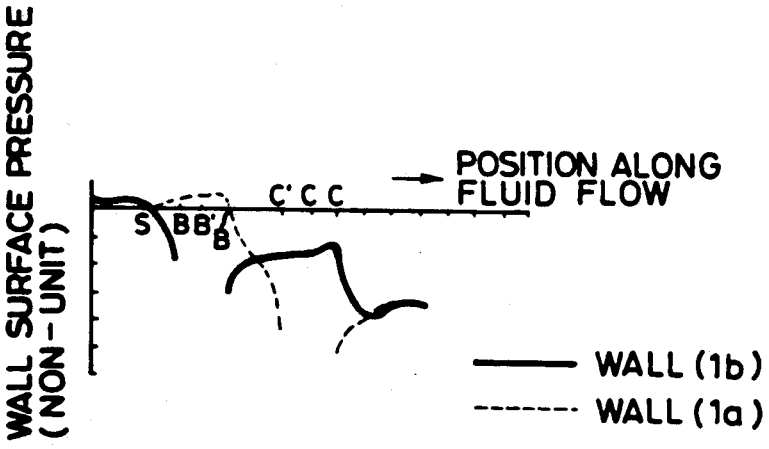

In FIGS. 21*a* and 21*b*, a heat exchanger is composed of corrugated and perforated heat transmission members 1*a* and 1*b* arranged in phase to form a zig-zag passage through which the fluid A flows without substantial fluid flow through the perforations 13. As to the pressure difference produced between opposite sides of the heat transmission member 1*a* as well as 1*b*, reference is made to FIGS. 22*a* and 22*b*. (See "Fluid Flow and Heat Transmission in Corrugated Fluid Passage", Izumi et al., Journal of the Japanese Machinery Association, vol. 46, no. 412.) In FIG. 22*a*, reference numerals 1*a* and 1*b* indicate bent walls defining the fluid passage, and FIG. 22*b* shows the distribution of wall surface pressure along the fluid flow. From FIG. 22*b* it is clear that when the pressure of the wall 1*a* is high, that of the wall 1*b* is low. In other words, the pressure of the wall 1*a* is high around positions B' and C', while the pressure of the wall 1*b* is high around a region between positions B and C, that is, high pressure regions exist alternatingly. This principle is applied to the embodiment of FIGS. 21*a* and 21*b*.

Since there is no change of cross-sectional area of the fluid passage therealong, the effect of repeated rising of the boundary layer cannot be provided.

Figure 23:
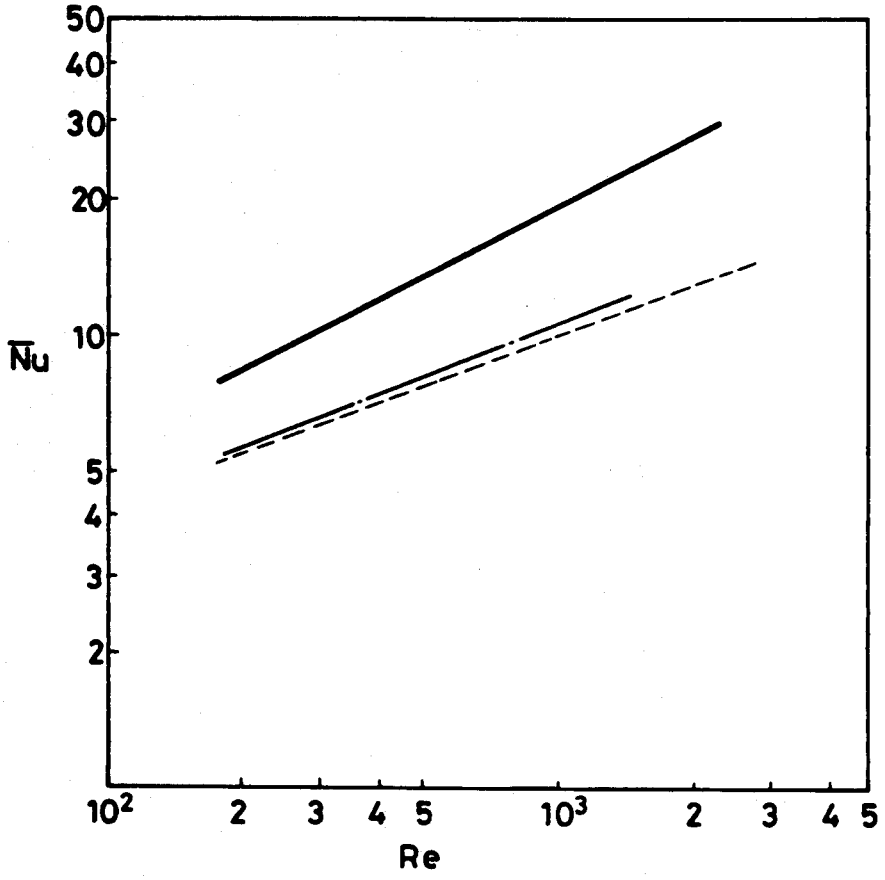
FIG. 23 is a graph showing heat transmission characteristics of another embodiment of the present invention.

FIG. 23 is a graph, similar to that shown in FIG. 18, showing the characteristics of the heat exchanger of FIGS. 21*a* and 21*b*. In FIG. 23, a solid-line curve indicates the characteristics of the previously described embodiment, a dotted-line curve those of the conventional parallel flat heat transmission members, and a chain-line curve those of heat transmission members having the same corrugation but without perforations. The chain-line curve is substantially the same as the dotted-line curve in at least the range of the Re number, which may be due to the lack of variation of cross-sectional area of the fluid passage. The solid-line curve indicates the superior characteristics of the present invention, even if there is no such effect as above. Although there is a considerable difference in these characteristics between the embodiments shown in FIG. 14 and FIG. 21, the difference tends to be reduced with an increase of the Reynolds number. As to fluid flow losses, it has been found that the embodiment shown in FIG. 14 is considerably lower than that shown in FIG. 21. Therefore, the selection of the heat transmission member should be done according to the application at hand.

Figure 24:
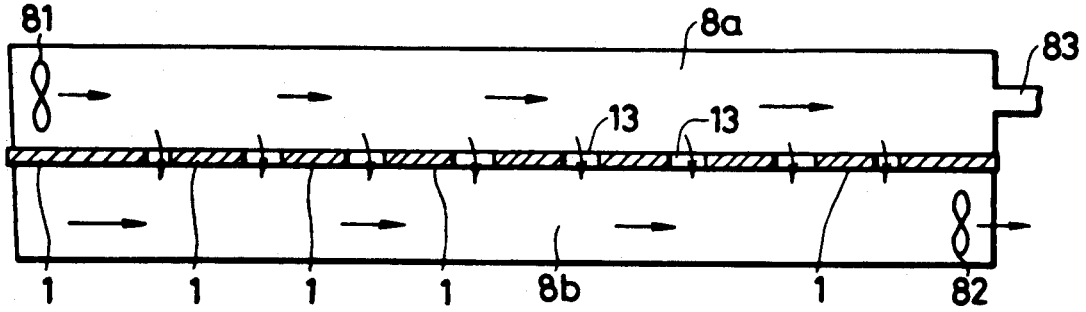
FIGS. 24 and 25 are cross sections of other respective embodiments of the present invention.

FIG. 24 shows a cross section of another embodiment of a heat exchanger the present invention, which is composed of a pair of ducts 8*a* and 8*b* arranged on opposite sides of a perforated flat heat transmission member 1. Fans 81 and 82 are provided in the ducts 8*a* and 8*b*, respectively. Inlets and outlets of the ducts 8*a* and 8*b* are opened to the atmosphere, with the outlet 83 of the duct 8*a* being reduced in cross-sectional area. With this construction, since the total pressure in the duct 8*a* is higher than that in the duct 8*b*, a portion of the fluid flowing through the duct 8*a* (with the aid of the fan 81) passes through the perforations 13 into the duct 8*b*. Therefore, a desired pressure difference is produced between the opposite surfaces of the heat transmission member 1, resulting in an improvement of the heat transmittance.

Figure 25:
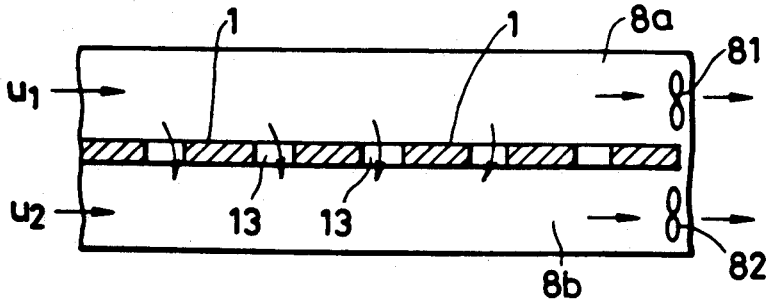

FIG. 25 shows a cross-sectional view of another embodiment of a heat exchanger of the present invention, which is similar to the embodiment of FIG. 24 and in which the total pressure in the duct 8a is made equal to that in the duct 8b and the fluid velocity $u_1$ in the duct 8a is made different from than that ($u_2$) in the duct 8b by making the speeds of the fans 11 and 82 different. If $u_1 < u_2$, the static pressure $p_1$ in the duct 8a is higher than that $p_2$ in the duct 8b, and thus a portion of the fluid flowing through the duct 8a passes through the perforations 13 into the duct 8b as indicated.

Figure 26A:
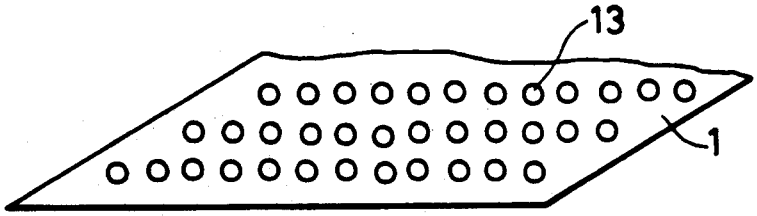
FIGS. 26a and 26b are illustrations of throughholes of other embodiments of the present invention.
Figure 26B:
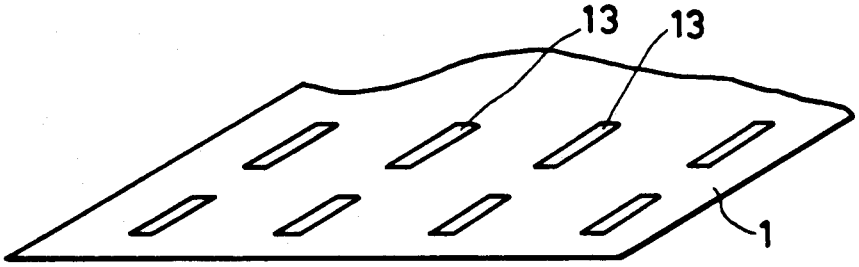

FIGS. 26 and 26b show examples of the perforations 13, but the exact configuration of the perforations 13 is not so important. In FIG. 26a, the configuration of the perforations 13 is circular, and in FIG. 26b, it is rectangular. There may be an optimum diameter or area of each perforation 13 and an optimum opening ratio of the heat transmission member 1 under certain conditions.

Figure 27:
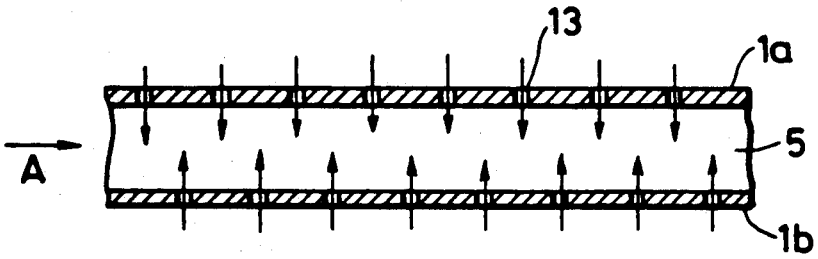
FIG. 27 illustrates a positional relation of the through-holes of another embodiment of the present invention.

In any case, the positional relation of the perforations of one heat transmission member to those of another heat transmission member associated therewith is important. FIG. 27 illustrates this relation. As shown in FIG. 27, perforations 13 of a heat transmission member 1a are shifted with respect to those of another heat transmission member 1b faced thereto through a passage 5 through which a fluid A flows. It is known empirically that the heat transmission is enhanced with such a shifted arrangement of the perforations 13. This is because, if the perforations 13 of one heat transmission member are aligned with those of another heat transmission member, fluid components blown from such perforations 13 will interfere with each other due to the inertia of the blown fluid components, resulting in a reduction of the amount of fluid passing through the perforations.

Figure 1A:
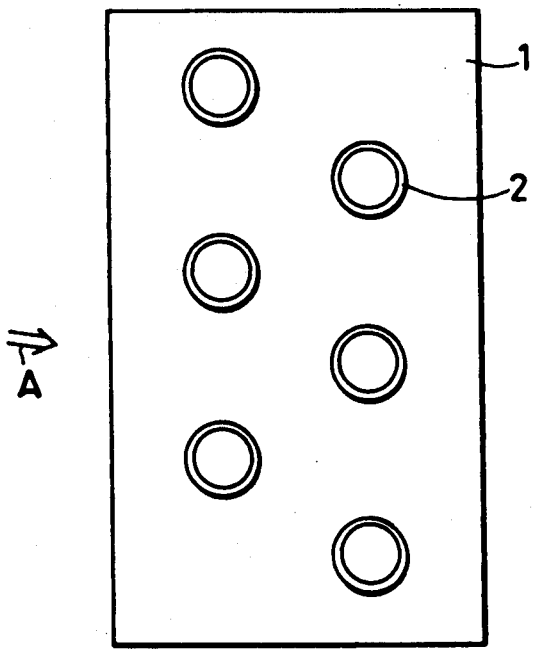
FIG. 1A PRIOR ART
FIG. 1*a* and 1*b* are a front and side view, respectively, of a conventional heat exchanger.
Figure 1B:
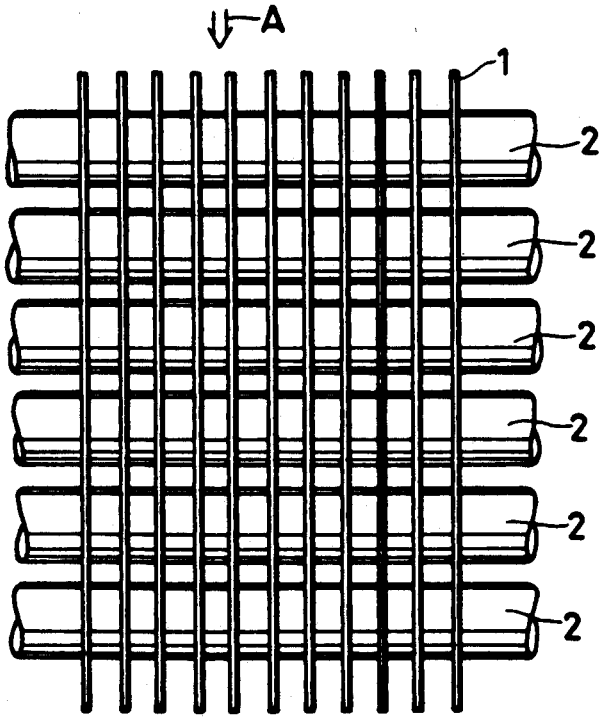
FIG. 1B PRIOR ART
Figure 2A:
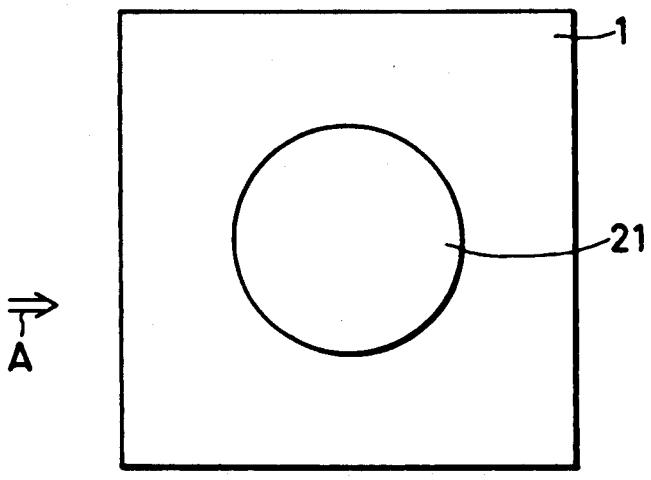
FIG. 2A PRIOR ART
FIG. 2*a* and 2*b* are a front and side view, respectively, of another conventional heat exchanger.
Figure 2B:
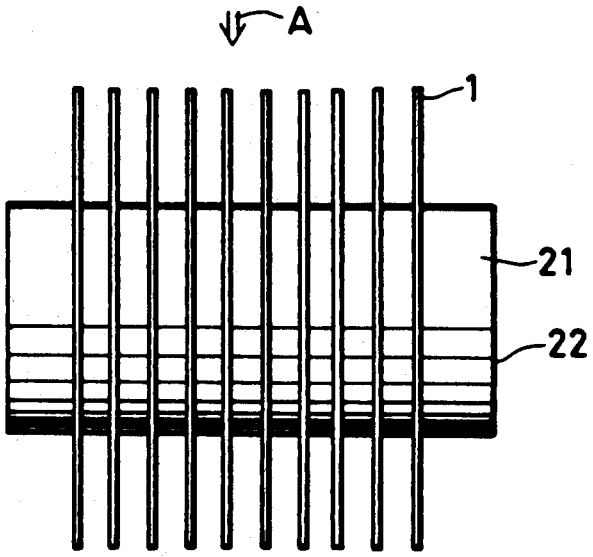
FIG. 2B PRIOR ART
Figure 3:
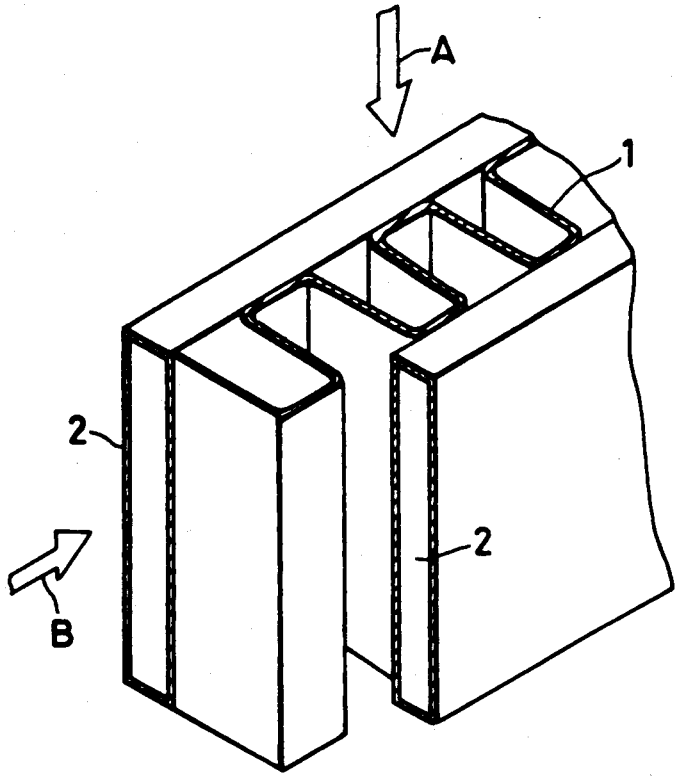
FIG. 3 PRIOR ART
FIG. 3 is a perspective view of a portion of another conventional heat exchanger.
Figure 4:
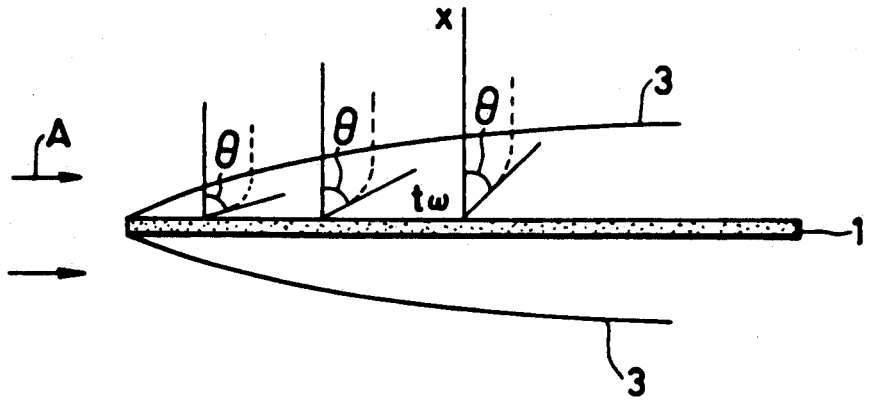
FIG. 4 PRIOR ART
FIG. 4 is an explanatory illustration of the conventional heat exchanger shown in FIG. 3.
Figure 5:
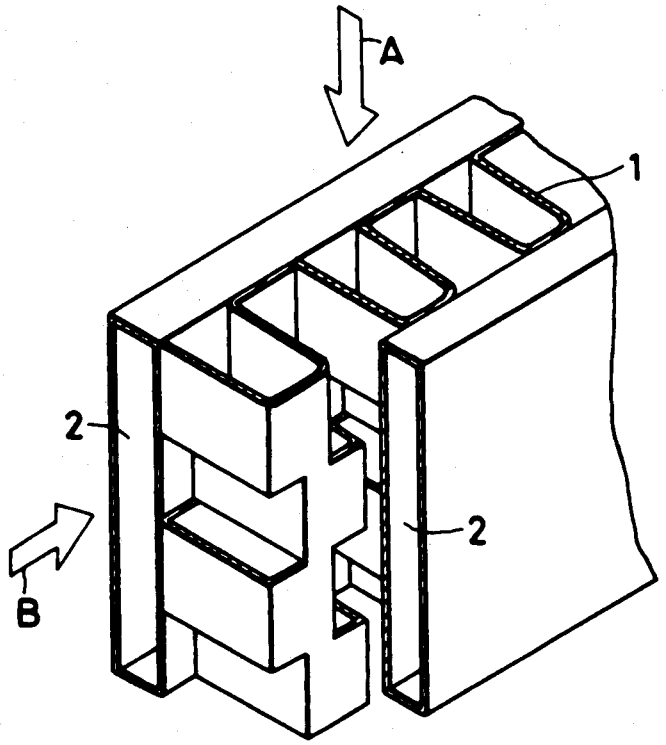
FIG. 5 PRIOR ART
FIG. 5 is a perspective view of a portion of another conventional heat exchanger.
Figure 6:
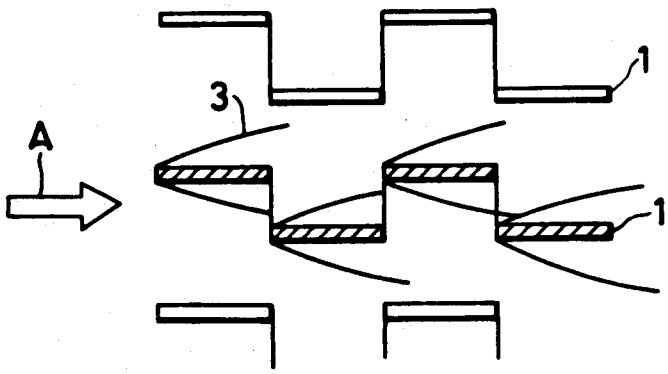
FIG. 6 PRIOR ART
FIG. 6 is an explanatory illustration of the heat exchanger in FIG. 5.
Figure 7:
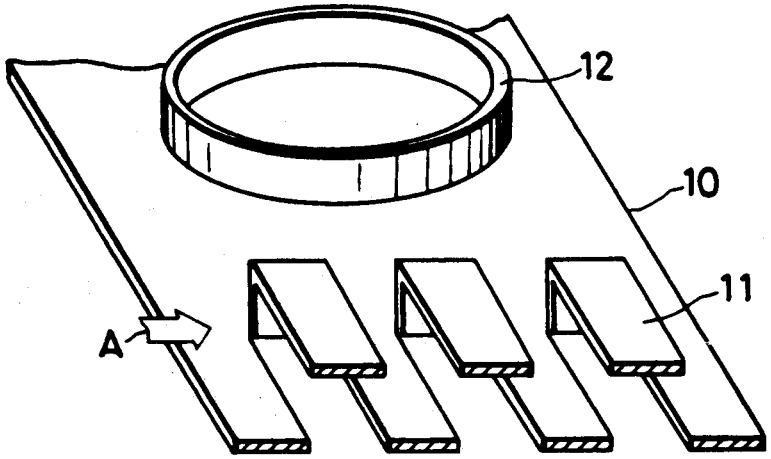
FIG. 7 PRIOR ART
FIG. 7 is a perspective view of a conventional heat transmission member utilizing the leading edge
Figure 8:
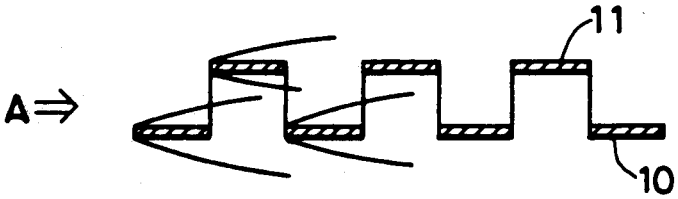
FIG. 8 PRIOR ART
FIG. 8 is a cross section of the heat transmission member in FIG. 7.
Figure 9:
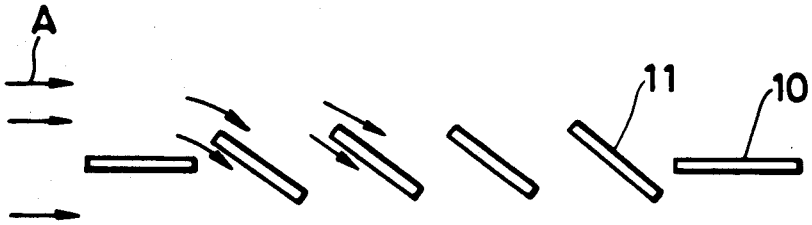
FIG. 9 PRIOR ART
FIG. 9 shows another conventional heat transmission member utilizing the leading edge effect.
Figure 10:
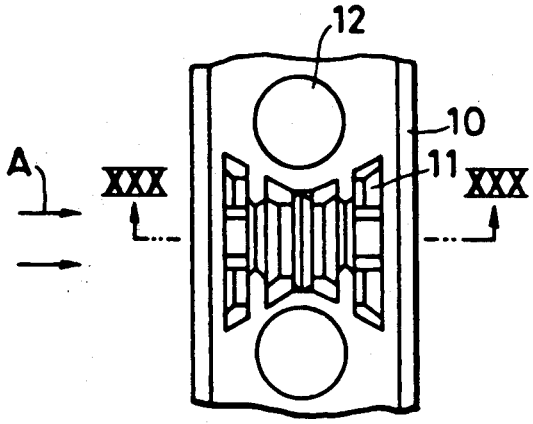
FIG. 10 PRIOR ART
FIG. 10 is a front view of another conventional heat transmission member utilizing the leading edge effect.
Figure 11:
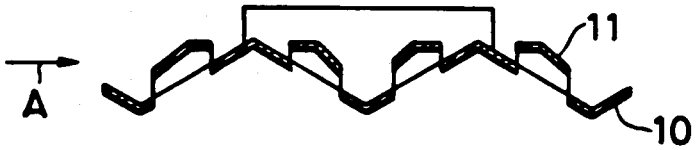
FIG. 11 PRIOR ART
FIG. 11 is a cross section taken along a line XXX—XXX in FIG. 10.
Figure 12:
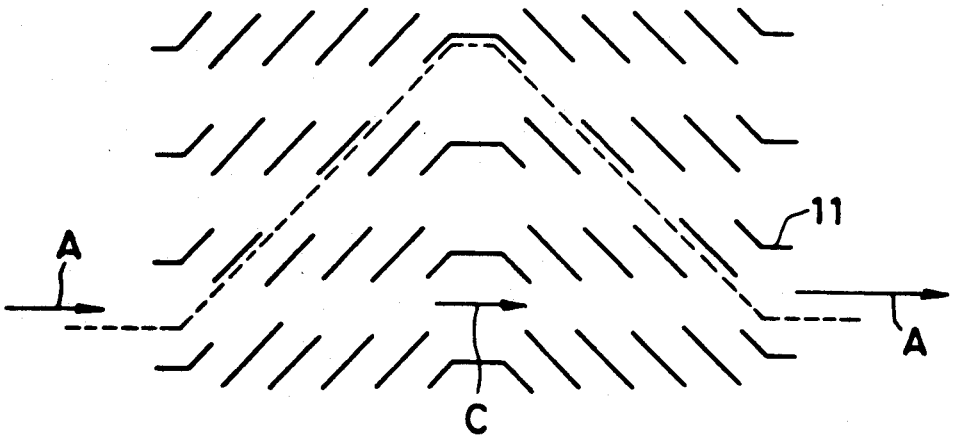
FIG. 12 PRIOR ART
FIGS. 12 and 13 depict other conventional heat transmission members each utilizing the leading edge effect.
Figure 13:
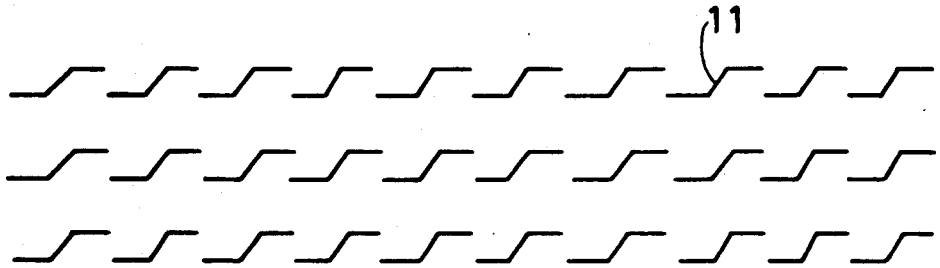
FIG. 13 PRIOR ART
Figure 28A:
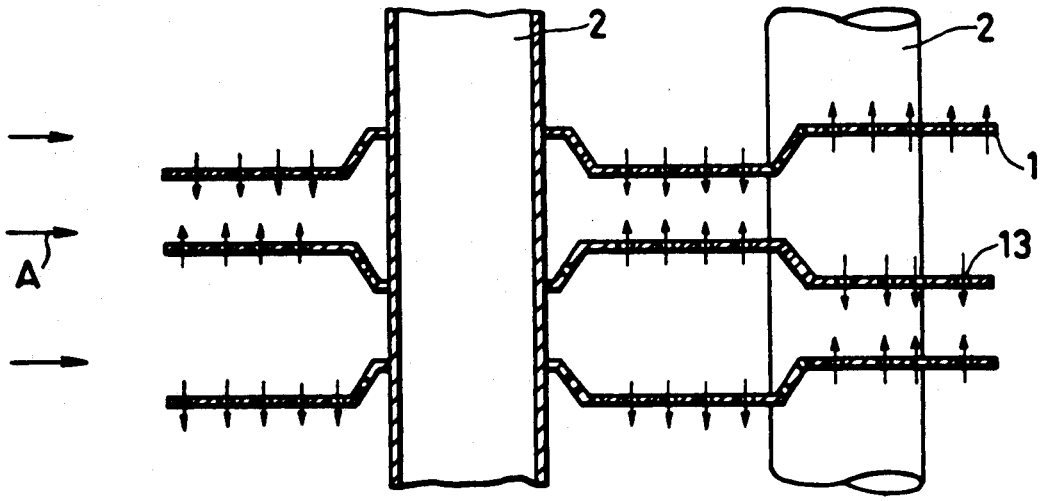
FIG. 28a is a schematic illustration of a heat exchanger according to another embodiment of the present invention.
Figure 28B:
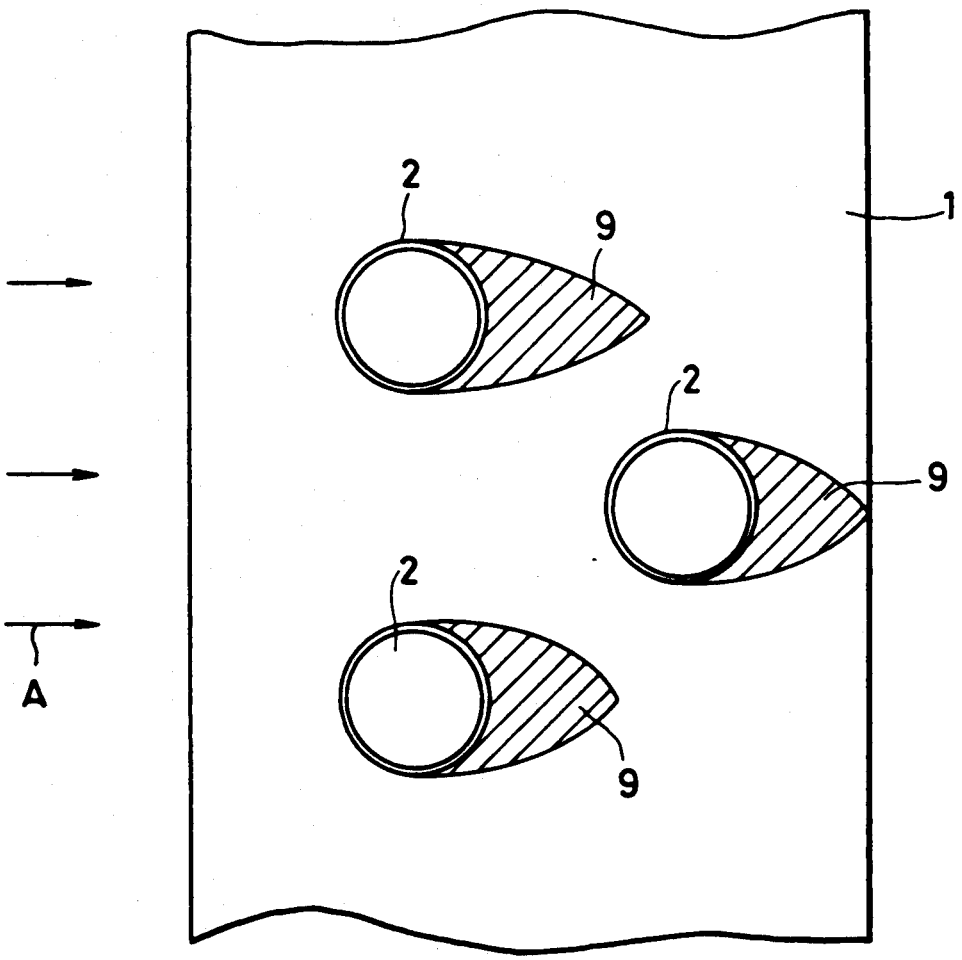
FIG. 28b is an illustration of a dead-water region of the conventional heat exchanger.

FIG. 28a shows an application of the inventive heat transmission members depicted in FIG. 14 to the heat exchanger shown in FIG. 1. It has been known, in the embodiment shown in FIG. 14, that there exists a dead zone behind each second heat transmission member, i.e., the pipe 2 as shown by reference numeral 9 in FIG. 28b, in which the heat transmittance of the first heat transmission member, i.e., the fin 1, is minimized. With the inventive heat transmission member, a fluid component which otherwise would stagnate in each dead zone 9 is made to move, and thus the heat transmittance in the dead zone is improved.

Figure 29:
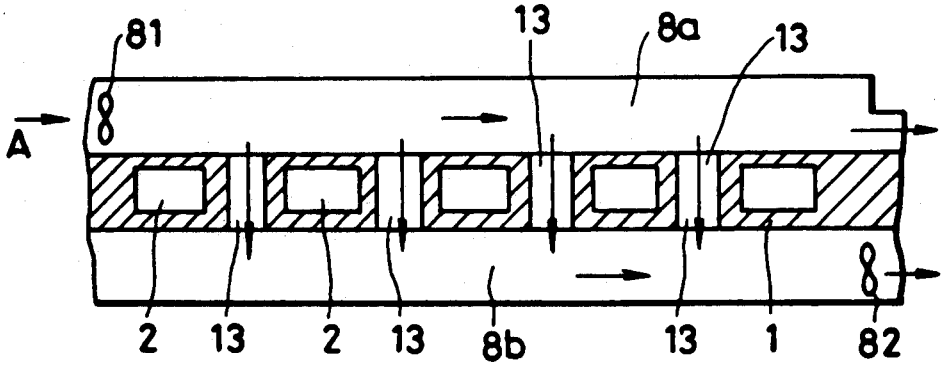
FIG. 29 is a cross section of another heat exchanger according to the present invention.
Figure 30:
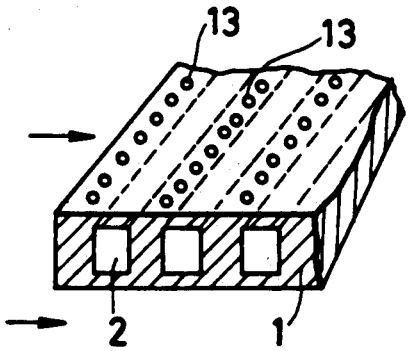
FIG. 30 is a perspective view of a portion of the embodiment in FIG. 29.

FIG. 29 is a cross section of another embodiment of the present invention, and FIG. 30 is a perspective view of a portion of the heat exchanger in FIG. 29. In this embodiment, second heat transmission members are incorporated in a first heat transmission member 1. That is, this embodiment is basically similar to that shown in FIG. 24 except that the first heat transmission member 1 having perforations 13 is made relatively thick and a passage 2 is formed between adjacent perforations 13 and extending orthogonally to the fluid passage A. The passages 2 serve as the second heat transmission members. With this arrangement, heat exchange between the fluid A flowing through the ducts 8a and 8b and a fluid flowing through the passages 2 is achieved very efficiently.

Figure 31A:
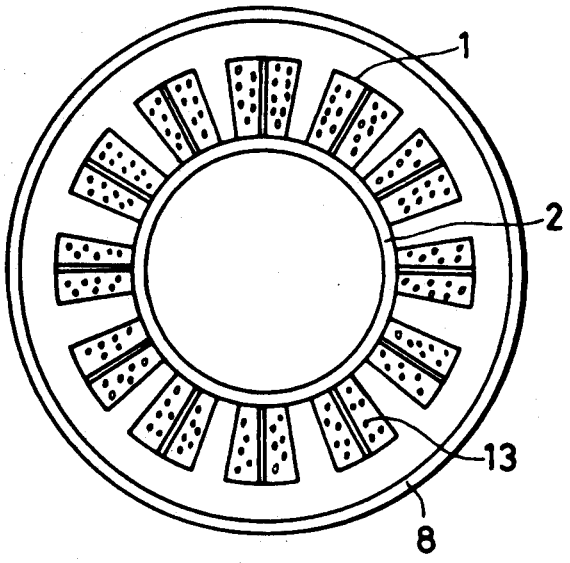
FIG. 31a and 31b are a side view and a partial cross section, respectively, of another embodiment of the present invention.
Figure 31B:
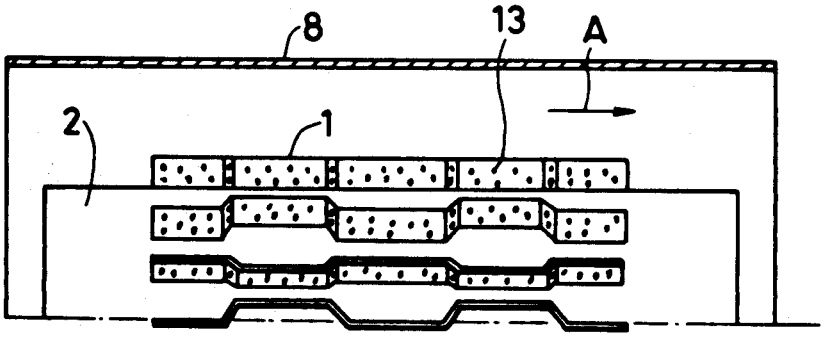

According to the present embodiment in which the cross-sectional area of the fluid passage is alternatively expanded and reduced, the heat transmittance is not substantially influenced by the length of the heat transmitting area distributed parallel to the fluid passage due to the effects of the repeated production of the boundary layer. Therefore, there is substantially no loss of the heat transmission enhancing effect, even if the heat exchanger is formed by a pipe 2, fins are attached to an outer surface of the pipe 2, and a duct 8 surrounds the pipe 2 and the fins 1, as shown in a longitudinal cross section in FIG. 31a and in a partial transversal cross section in FIG. 31b. This structure may be useful for an atomic pile. In such case, the pipe 2 may be fuel rod. This is also applicable to a heat generating member such as a motor housing. The duct 8 may be eliminated if necessary. However, the use of the duct 8 may be effective to stabilize the fluid flow and increase the flow rate thereof. If the edges of the fins 1 opposite the edges thereof in contact with the pipe 2 are in contact with an inner wall of the duct 8, these effects are enhanced.

Figure 32A:
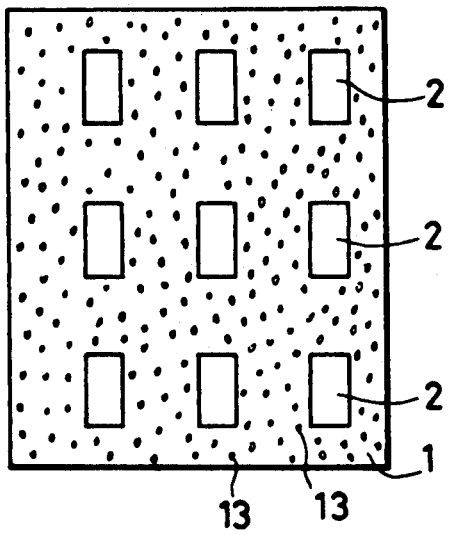
FIG. 32a and 32b are a plan view and a crosssectional view, respectively, of another embodiment of the present invention.
Figure 32B:
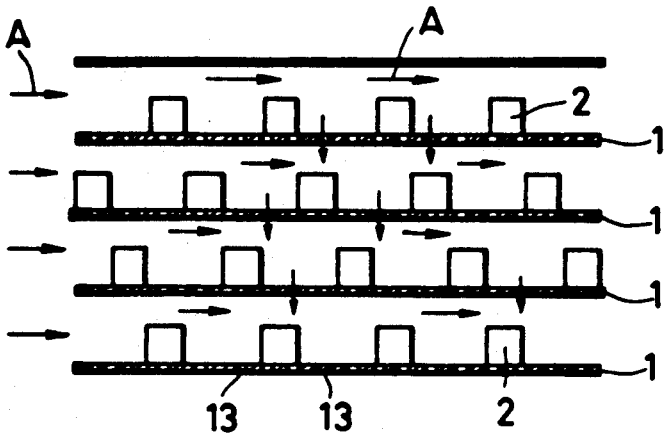

FIG. 32a and 32b show another embodiment of the present invention in a plan view and in a cross-sectional view, respectively, applied to an IC device. In these figures, each printed circuit board 1 has perforations 13, and a plurality of IC elements 2 are disposed on the board 1. The printed circuit board 1 constitutes the first heat transmission member. The cross-sectional area of the fluid flow A is alternatively increased and decreased due to the presence of the IC elements 2 to thereby provide the heat transmission enhancing effect. Dead zones behind the IC elements 2 are effectively eliminated as mentioned in the embodiment shown in FIG. 28a.

Since the fins of the heat exchanger of the invention are not divided into strips, there is no aerodynamic resistance produced at the leading edges thereof, and hence the problem of mechanical strength of the fins is eliminated.

Figure 33:
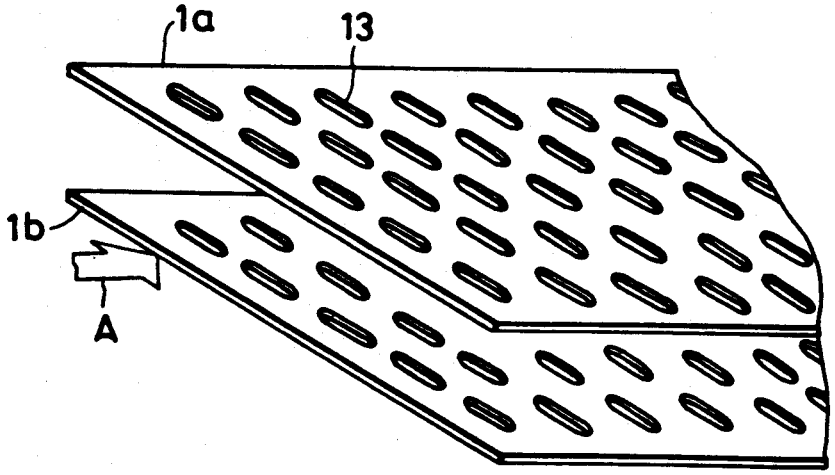
FIG. 33 PRIOR ART
FIG. 33 is a perspective view of a conventional perforated fin.
Figure 34:
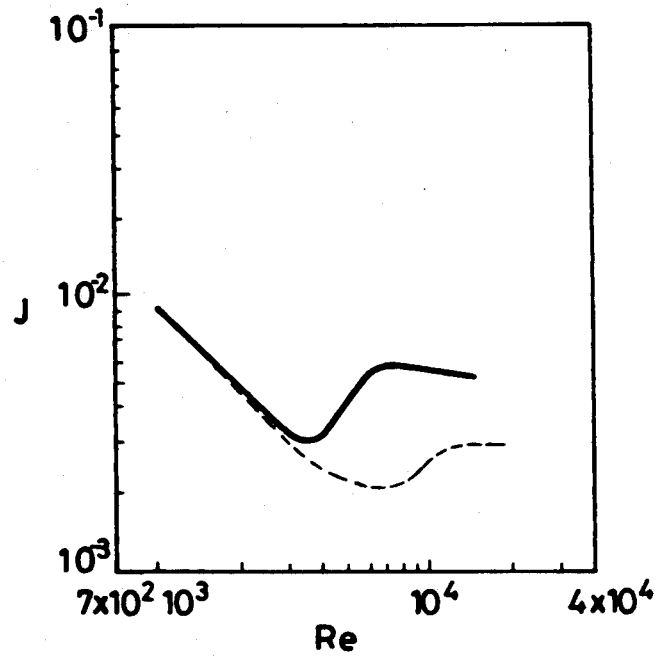
FIG. 34 is a graph showing heat transmission characteristics of the heat exchanger in FIG. 33.
Figure 35:
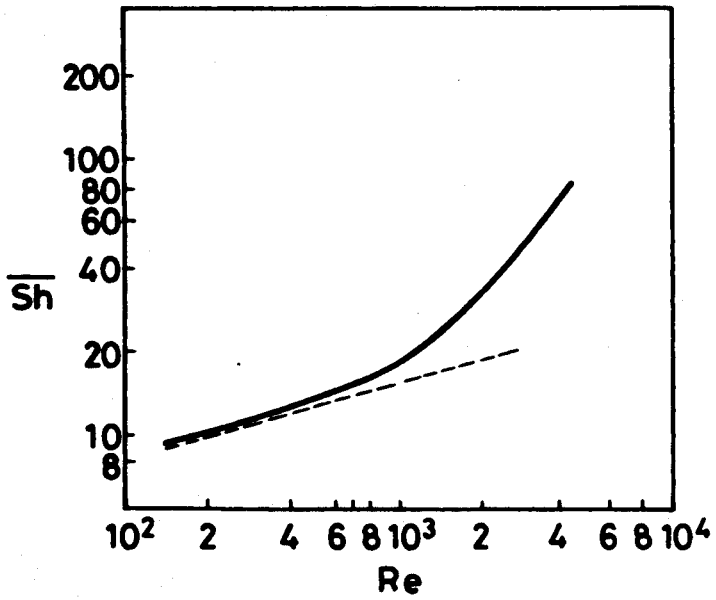
FIG. 35 is a graph showing a heat transmission characteristics of another heat exchanger having a corrugated fluid path.

FIGS. 33 to 35 show a fluid passage defined by conventional perforated fins and the heat transmission characteristics thereof, and also those of conventional corrugated fins, thereby demonstrating the superiority of the present invention.

In FIG. 33, a fluid passage A is defined by a pair of heat transmission members 1a and 1b each having slot-like through-holes 13, and FIG. 34 shows the heat transmission characteristics thereof with the ordinate and abscissa indicating J (the Colburn J factor) and Re (Reynolds number), respectively. (See an article by C. Y. Liang et al. in "ASME Journal of Heat Transfer", Feb. 1975, page 12).

From FIG. 34, it is clear that the heat transmission characteristics of the perforated fin, shown by a dotted-line curve, are substantially the same as those of the conventional parallel flat fin, shown by a solid line, in a range of Reynolds numbers less than about 3000. This is completely different from the characteristics of the present invention, and hence it has been demonstrated that the heat exchanger of the present invention has heat transmission characteristics significantly better than would be expected from a mere combination of a corrugated fin and a perforated fin.

FIG. 35 shows the heat transmission characteristics of of the above expressed by the average Sherwood number Sh (which corresponds to the Nusselt number Nu) and the Reynolds number Re, (see an article by Goldstein et al. in, "ASME Journal of Heat Transfer", May 1977, vol. 99, page 194), in which a dotted-line curve and a solid-line curve indicate the heat transmission characteristics of the parallel flat fin and the corrugated fin, respectively. As is clear from FIG. 35, the heat transmission characteristics of these fins are substantially the same when Re 1000. This is again considerably different from the characteristics of the present invention and demonstrates further the unexpected favorable results provided by the invention, which one would not expect from a mere combination of a parallel flat fin and a corrugated fin.

That is, the present invention provides a considerably improved heat transmission enhancing effect, and particularly, for a low range of Reynolds numbers.

Although the term "heat transmission member" has been used to indicate a fin and pipe mainly, it may be used interchangeably for other components, such as a heat generating member, heat sink, heat accumulating member, or radiator. The fluids with which the invention may be used include gases such as air and liquids including water.

What is claimed is:

1. A heat exchanger apparatus comprising: a heat transmission member having a plurality of through-holes, said heat transmission member extending in a direction of fluid flow and being corrugated in the direction of fluid flow in the form of alternating trapezoids to produce a pressure difference between opposite surfaces of each of plural portions of said heat transmitting member; and main flow guide means for guiding a main portion of said fluid flow such that it does not pass through said through-holes but flows along said heat transmitting member.

2. The apparatus as claimed in claim 1, wherein a plurality of said heat transmission members are arranged in parallel and said fluid flows through paths provided between respective adjacent ones of said heat transmission members.

3. The apparatus as claimed in claim 2, wherein said each of said heat transmission members comprises, in a stack, a corrugated member and a flat member.

4. The apparatus as claimed in claim 2, wherein said through-holes of adjacent ones of said heat transmission members are offset in position from each other in the direction of said fluid flow.

5. A heat exchanging apparatus comprising: a first heat transmission member having a plurality of through-holes formed therein, said heat transmission member extending in the direction of fluid flow and being corrugated in the direction of fluid flow in the form of alternating trapezoids to produce a pressure difference between opposite sides of one portion of said first heat transmission member; a second heat transmission member coupled thermally to said first heat transmission member, a temperature of said first heat transmission member being different from that of said second heat transmission member; and main fluid guide means for guiding a main flow of said fluid along said first heat transmission member while preventing said main flow from passing through said through-holes of said first heat transmission member.

6. The apparatus as claimed in claim 5, wherein said second heat transmission member is arranged to block said main flow along said first heat transmission member.

7. The apparatus as claimed in claim 6, wherein said second heat transmission member comprises pipes coupled to said first heat transmission member.

8. The apparatus as claimed in claim 7, wherein said pipes are heat pipes.

9. The apparatus as claimed in claim 5, wherein a plurality of said first heat transmission members are provided and a fluid path is formed between adjacent ones of said first heat transmission member.

10. The apparatus as claimed in claim 9, wherein a cross-sectional area of each of said fluid paths varies therealong.

11. The apparatus as claimed in claim 10, wherein said first heat transmission members are corrugated periodically along respective ones of said fluid paths, and said corrugations of adjacent ones of said first heat transmission members are different in phase.

12. The apparatus as claimed in claim 10, wherein each of said first heat transmission members comprises a first corrugated heat transmission member and a first flat heat transmission member stacked together.

13. A heat exchanging apparatus comprising: a first heat transmission member having a uniform distribution of a plurality of through-holes in at least one portion thereof, said heat transmission member extending in said direction of fluid flow; a second heat transmission member coupled thermally to said first heat transmission member, a temperature of said first heat transmission member being different from that of said second heat transmission member; heat transmission enhancing means for producing a pressure difference between opposite sides of one portion of said first heat transmission member; and main fluid guide means for guiding a main flow of said fluid along said first heat transmission member while preventing said main flow from passing through said through-holes of said first heat transmission member; and wherein said heat transmission enhancing means is provided by corrugating said first heat transmission member periodically in the direction of said fluid flow to form alternating trapezoids.

14. A heat exchanger apparatus, comprising: a heat transmission member extending in a direction of fluid flow; heat transmission enhancing means for producing a pressure difference between opposite surfaces of each of plural portions of said heat transmitting member, each of said plural portions of said heat transmitting member having a uniform distribution of a plurality of through-holes therein; and main flow guide means for guiding a main portion of said fluid flow such that it does not pass through said through-holes but flows along said heat transmitting member.

15. The apparatus as claimed in claim 14, wherein higher pressure sides of said heat transmission enhancing means alternate in the direction of said fluid flow.

16. The apparatus as claimed in claim 14, wherein said heat transmission enhancing means is provided by corrugating said heat transmission member in the direction of said fluid flow.

17. The apparatus as claimed in claim 16, wherein said heat transmission enhancing means is provided by corrugating said heat transmission member periodically in the form of alternating trapezoids.

18. The apparatus as claimed in claim 14, wherein a plurality of said heat transmission members are arranged in parallel and said fluid flows through paths provided between respective adjacent ones of said heat transmission members.

19. The apparatus as claimed in claim 18, wherein said through-holes of adjacent ones of said heat transmission members are offset in position from each other in the direction of said fluid flow.

20. The apparatus as claimed in claim 18, wherein a cross-sectional area of each of said paths varies in the direction of said fluid flow.

21. The apparatus as claimed in claim 20, wherein the variations in cross-sectional areas of adjacent paths are different in phase.

22. The apparatus as claimed in claim 21, wherein said variations in cross-sectional area are obtained by corrugating at least one of every two adjacent heat transmission members and said corrugations have an alternating trapezoidal shape.

23. The apparatus as claimed in claim 20, wherein each of said heat transmission members comprises, in a stack, a corrugated member and a flat member.

24. The apparatus as claimed in claim 14, wherein said heat transmission enhancing means comprises means for producing a pressure difference between said fluid paths on said opposite sides of said heat transmission member.

25. The apparatus as claimed in claim 24, wherein said fluid flow in one of said fluid paths has a different velocity from said fluid flow in the other of said fluid paths.

26. The apparatus as claimed in claim 14, further comprising a throttle provided in one of said fluid paths on said opposite sides of said heat transmission member.

27. A heat exchanger apparatus, comprising:

a heat transmission member having first, intermediate and second sections arranged along a direction of fluid flow, said second section having at least one perforation therein; and means for defining a first fluid path on a first side of said heat transmission member and a second fluid path on a second side of said heat transmission member, with the cross-sectional areas said first and second fluid paths having a first ratio along said first section of said heat transmission member, changing along said intermediate section of said heat transmission member and then having a second ratio along said second section of said heat transmission member, the length of said second section being substantially longer than said intermediate section.

28. A heat exchanger as claimed in claim 27, wherein said second section has uniform distribution of a plurality of perforations arranged along the direction of fluid flow.

* * * * *